US007234910B2

(12) United States Patent
Boyapally et al.

(10) Patent No.: US 7,234,910 B2
(45) Date of Patent: Jun. 26, 2007

(54) BUCKET FOR PIN GRABBER COUPLER

(75) Inventors: Pandu R. Boyapally, Aurora, IL (US); Douglas R. Bye, Hinckley, IL (US); Jeffry J. Kurtz, Yorkville, IL (US)

(73) Assignee: Caterpillar Inc, Peoria, IL (US)

( * ) Notice: Subject to any disclaimer, the term of this patent is extended or adjusted under 35 U.S.C. 154(b) by 110 days.

(21) Appl. No.: 11/175,946

(22) Filed: Jul. 6, 2005

(65) Prior Publication Data

US 2007/0020079 A1 Jan. 25, 2007

(51) Int. Cl.
*E02F 3/40* (2006.01)

(52) U.S. Cl. ..... 414/723; 37/411; 37/468; 403/10; 403/324; 414/722

(58) Field of Classification Search ..... 414/722, 414/723; 37/411, 468; 172/272–275; 403/10, 403/324

See application file for complete search history.

(56) References Cited

U.S. PATENT DOCUMENTS

| | | | | |
|---|---|---|---|---|
| 2,967,726 | A | 1/1961 | Weston | |
| 3,543,863 | A | 12/1970 | Ball et al. | |
| 4,096,957 | A | 6/1978 | Iverson et al. | |
| 4,133,121 | A | 1/1979 | Hemphill | |
| 4,243,341 | A | 1/1981 | Kabay et al. | |
| 4,251,182 | A | 2/1981 | Schroeder | |
| 4,398,862 | A | 8/1983 | Schroeder | |
| 4,400,898 | A | 8/1983 | Christensen et al. | |
| 4,607,977 | A | 8/1986 | Varnelis et al. | |
| 5,927,665 | A | 7/1999 | Grabnic | |
| 5,951,192 | A * | 9/1999 | Collins | 403/150 |
| 6,108,951 | A | 8/2000 | Renfrow et al. | |
| 6,158,917 | A | 12/2000 | Wolin et al. | |
| 6,273,632 | B1 | 8/2001 | Takahashi et al. | |
| 6,283,667 | B1 | 9/2001 | Neitzel | |
| 6,322,280 | B1 | 11/2001 | Coyne | |
| 6,364,561 | B1 * | 4/2002 | Droegemueller | 403/4 |
| 6,694,571 | B2 | 2/2004 | Albright et al. | |
| 6,877,259 | B2 * | 4/2005 | Nishimura et al. | 37/468 |
| 2002/0176772 | A1 * | 11/2002 | Hung | 414/723 |

FOREIGN PATENT DOCUMENTS

GB 2 362 371 B 9/2004

OTHER PUBLICATIONS

"Miller the Complete Solution," <http://www.miller-uk.com/index.php>, 3 pps., printed Jun. 23, 2005.

"Kenco Corporation, Hard Rock Excavator Buckets," <http://www.kenco.com/buckets_att.html>, 4 pps., printed Jun. 23, 2005.

* cited by examiner

*Primary Examiner*—Donald Underwood
(74) *Attorney, Agent, or Firm*—Andrew J. Ririe

(57) ABSTRACT

A bucket has a pair of longitudinally parallel and spaced apart pins for attaching to a pin grabber quick coupler. The pins may require removal from the bucket for repair or replacement if the pins are damaged. One or more windows are formed in the side of the bucket for facilitating access to and the removal of the pins from the bucket.

12 Claims, 8 Drawing Sheets

BUCKET FOR PIN GRABBER COUPLER

This utility patent application is related by subject matter to U.S. design patent application Ser. No. 29/233,700 filed on Jul. 6, 2005.

TECHNICAL FIELD

The field of this invention is buckets for earth working machines, and more specifically buckets with a pair of parallel, spaced apart pins for attaching to a pin grabber quick coupler.

BACKGROUND

Excavators are used for digging and various other operations. Excavators typically comprise a machine platform with a cab, engine, and other systems. A boom is typically pivotally attached at a horizontal axis to the machine platform. A stick is typically attached at a horizontal axis to the boom. At the end of the stick, a work tool, such as a digging bucket, is attached. Buckets can be attached to the stick via quick couplers. Quick couplers facilitate the coupling and decoupling of buckets to the end of the stick, and typically permit the operator to perform these operations without leaving the cab of the excavator.

A pin grabber quick coupler utilizes hooks on the coupler to attach to elongated, typically cylindrical pins on the bucket. The pin grabber quick coupler is attached to the end of the excavator stick. One or more of the hooks is actuated, such as by hydraulic cylinders, to grasp the pins on the bucket and hold the bucket to the coupler.

The bucket illustrated in UK published patent application GB 2 362 371 A is one example of a bucket with pins for attaching to a pin grabber quick coupler. The bucket has a pair of pins 25, 27 permitting the bucket to be grasped and retained by a pin grabber coupler. One disadvantage of this bucket design is that at least pin 25 cannot be easily accessed for repair or replacement. The pins in this bucket, and in buckets of similar construction, can be damaged. Damaged pins can cause the coupler to grasp the bucket incorrectly, or can prevent the coupler from grasping the bucket at all. When the pins are damaged, they must be removed and repaired or replaced. The bucket design in UK published patent application GB 2 362 371 A does not permit easy removal of at least pin 25 for repair or replacement.

Among other advantages, this invention provides a bucket with a pair of pins which are easily removed from the bucket for repair or replacement.

SUMMARY OF THE INVENTION

In one embodiment of the invention, a bucket may comprise a pair of spaced apart and generally parallel first and second side plates, a base edge spanning between the first and second side plates, a top plate spanning between the first and second side plates, a throat defined by a front edge of the first side plate, a front edge of the second side plate, the base edge, and a front edge of the top plate, a bucket cavity between the first and second side plates, the base edge and the top plate for holding soil or other material, a pair of longitudinally parallel and spaced apart pins attached to the bucket, and at least one window formed in the first side plate aligned with at least one of the pair of pins in the longitudinal direction of the pin such that the longitudinal axis of the at least one of the pair of pins passes through the window.

In another embodiment, a bucket may comprise a pair of spaced apart and generally parallel first and second side plates, a base edge spanning between the first and second side plates, a top plate spanning between the first and second side plates, first and second gussets attached to the top plate, the first and second gussets being generally parallel to one another and spaced apart, the first and second gussets also arranged generally parallel to and situated between the first and second side plates, a pair of longitudinally parallel and spaced apart pins spanning between the first and second gussets, a first end of each pin being attached to the first gusset with a removable fastener, and a cover plate being attached to and spanning between the first gusset and the first side plate to generally enclose the first ends of each pin.

In another embodiment a bucket may comprise a throat though which soil or other material passes when entering the bucket, a bucket cavity for holding the soil or other material in the bucket, a pair of spaced apart and generally parallel first and second side plates partially defining the bucket cavity, a base edge spanning between the first and second side plates and partially defining the throat, a pair of longitudinally parallel and spaced apart pins attached to the bucket above the bucket cavity, and at least one window formed in the first side plate aligned with at least one of the pair of pins in the longitudinal direction of the pin such that the longitudinal axis of the at least one of the pair of pins passes through the at least one window.

DETAILED DESCRIPTION

FIGS. 1–8 illustrate a bucket 10 exemplifying the principles of the present invention. The bucket 10 is exemplary only and the invention may be incorporated into other buckets in a similar manner.

Figure 1:
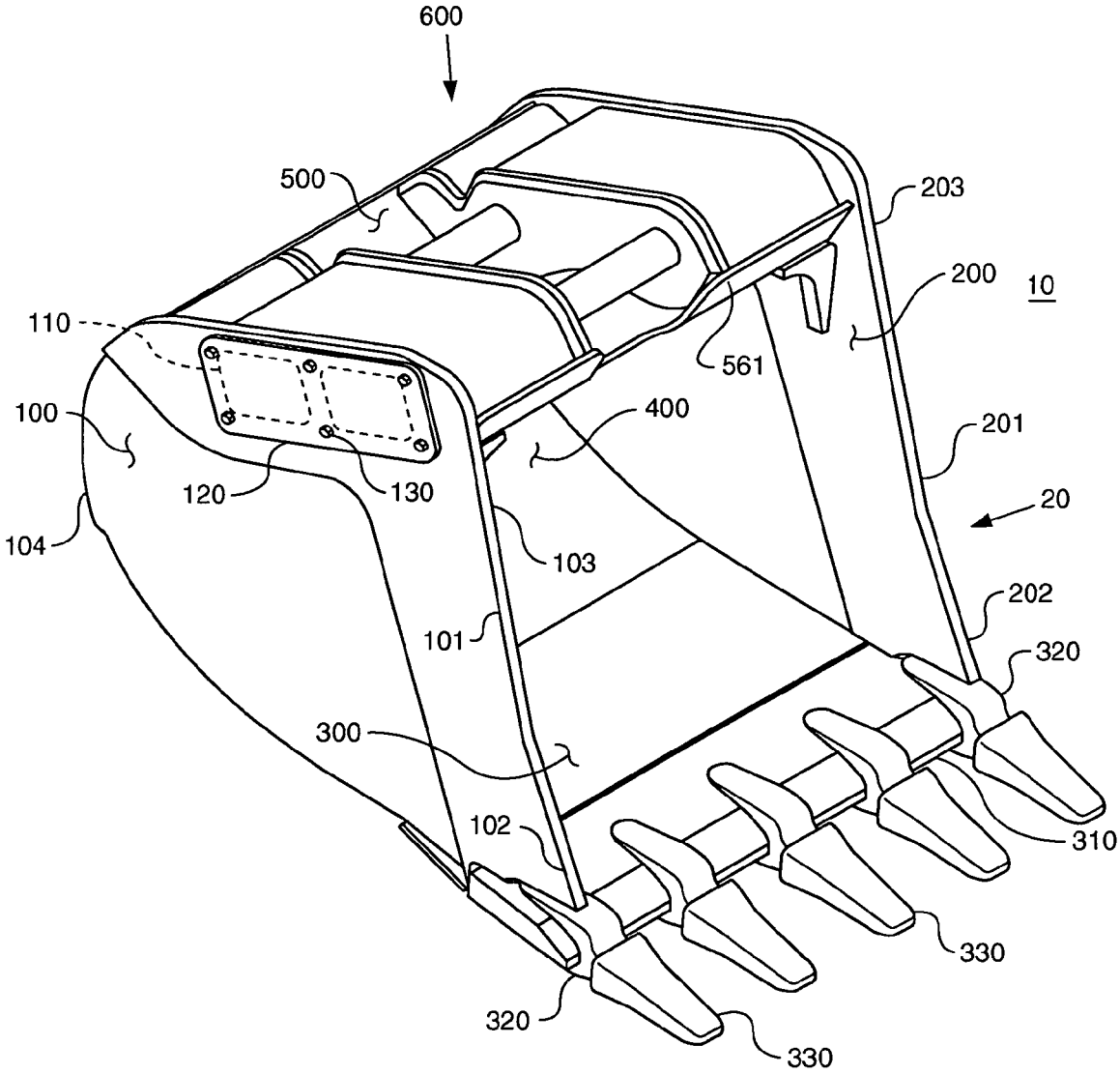
FIG. 1 is an isometric view of a bucket illustrating the principles of the invention.
Figure 2:
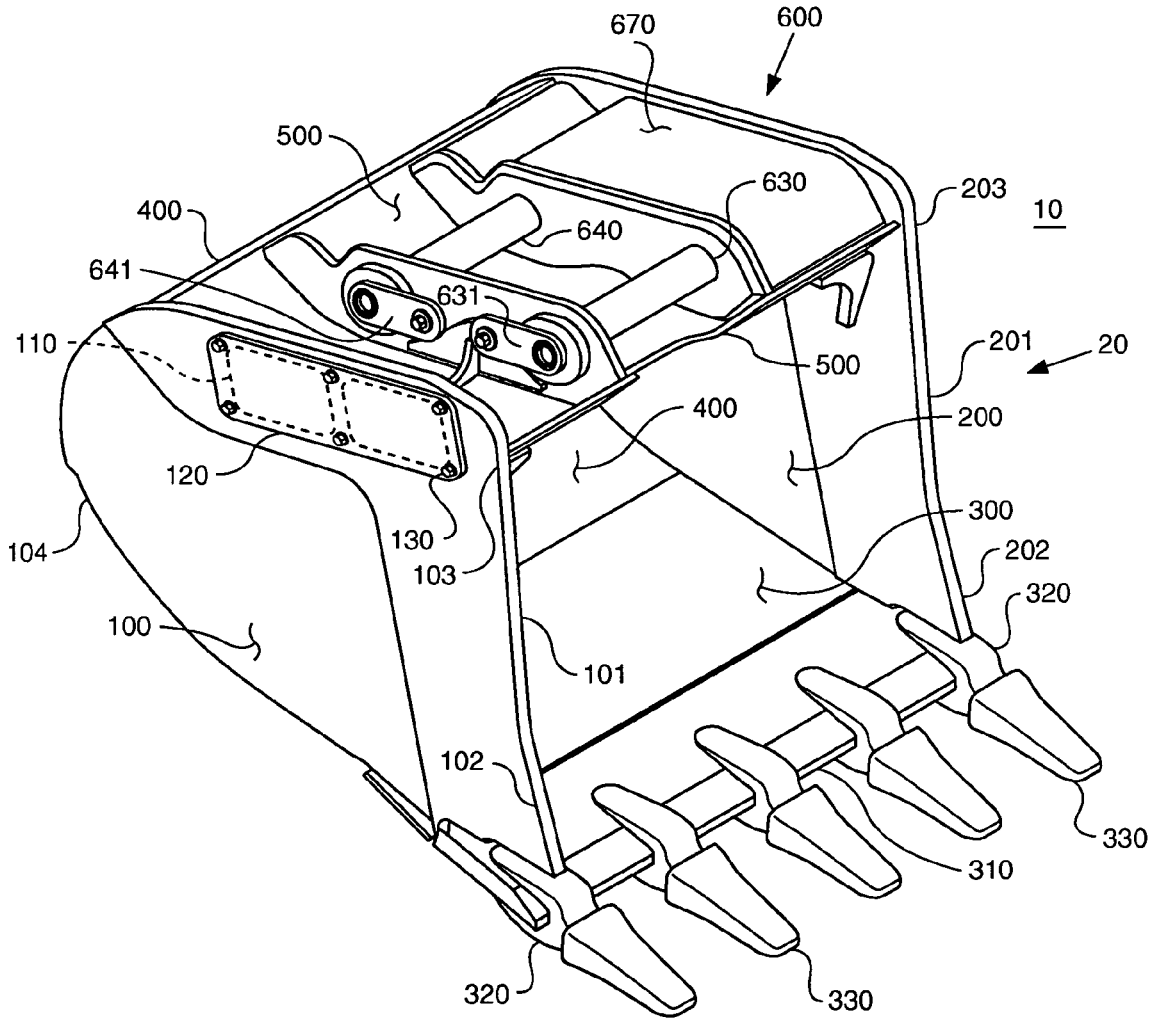
FIG. 2 is generally identical to FIG. 1 except that cover plate 660 has been removed.

With reference to FIGS. 1 and 2, bucket 10 includes generally flat, spaced apart and parallel side plates 100, 200. Side plates 100 and 200 are generally mirror images of one another in the drawing figures, but either could include variations. Each side plate 100, 200 includes a respective front edge 101, 201. Front edge 101 includes a first end 102 and an opposite second end 103. Front edge 201 includes a first end 202 and an opposite second end 203. Each side plate also includes a respective back edge 104, 204 curved generally in a "C"-shape. Back edges 104, 204 curve from respective first ends 102, 202 to second ends 103, 203 of the front edges 101, 201. The curve of back edges 104, 204 shown in the figures is exemplary only and other profiles are possible as will be understood by those of ordinary skill in this art. Back edges 104, 204 need not be continually curved and may include some straight sections.

Bucket 10 also includes a bottom plate 300. A portion of bottom plate 300 forms a base edge 310 which generally spans the distance from first ends 102, 202 of front edges 101, 201 of side plates 100, 200. A plurality of adapters 320 may be attached to the base edge 310. The adapters may each mount an earth engaging tooth 330. Other types of earth engaging tooth and adapter systems may also be attached to base edge 310.

Figure 4:
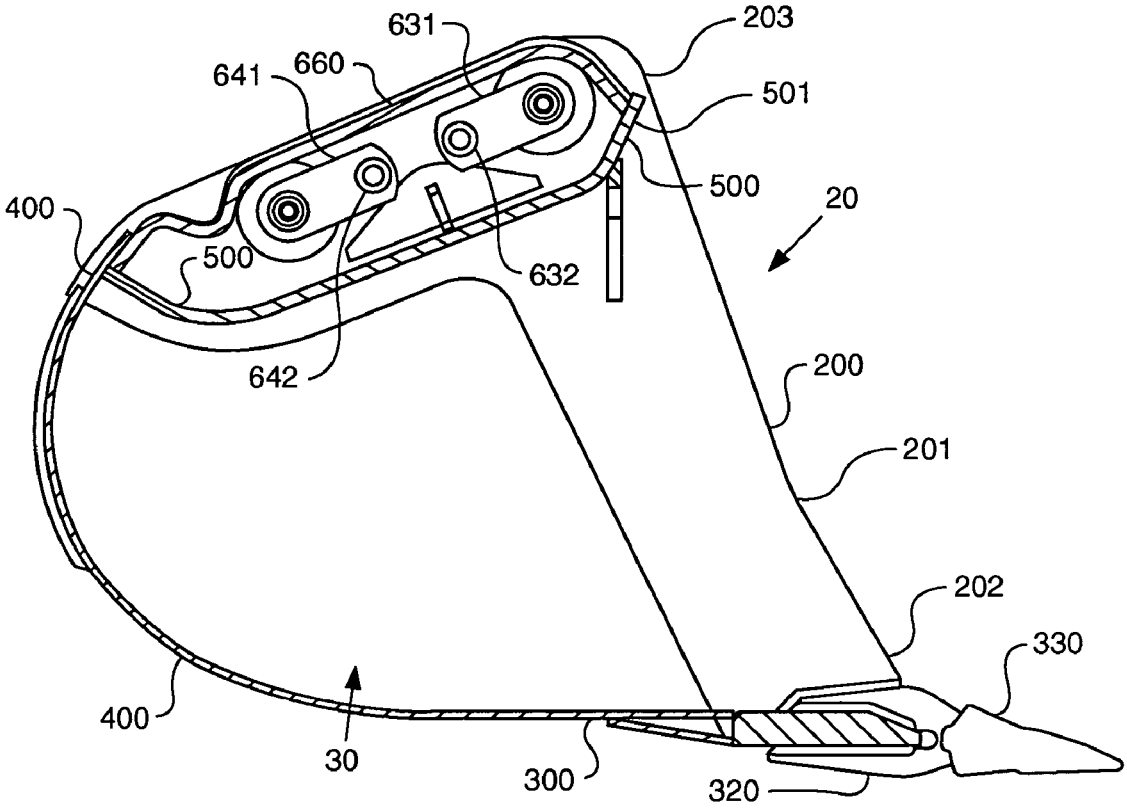
FIG. 4 is a sectional, side view of the bucket of FIG. 1 taken from cutting plane 4—4 shown in FIGS. 6 and 7.

Bucket 10 also includes a heel plate 400 which is at least partially curved, and a top plate 500. Heel plate 400 joins bottom plate 300 and spans between a portion of the back edges 104, 204 of side plates 100, 200. The curve of heel plate 400 may generally match the curve of the portion of back edges 104, 204, as shown in FIG. 4. Top plate 500 joins heel plate 400 and spans between side plates 100, 200. Top plate 500 includes a front edge 501 which spans between second ends 103, 203 of front edges 101, 201.

As shown in FIGS. 1–2 and 4–5, the front edge 501 of top plate 500, front edges 101, 201 of side plates 100, 200, and base edge 310 of bottom plate 300 form the throat 20 of the bucket 10. When digging, the soil or other material passes through the throat 20 of bucket 10, into the bucket cavity 30.

Side plates 100, 200, bottom plate 300, heel plate 400, and top plate 500 may be individual plates, or may comprise an assembly of plates, as will be understood by those of ordinary skill in this art.

As shown in FIG. 4, top plate 500 is concavely curved away from bucket cavity 30 of bucket 10. Above top plate 500 in the concave space is situated the pin coupling system 600.

Figure 3:
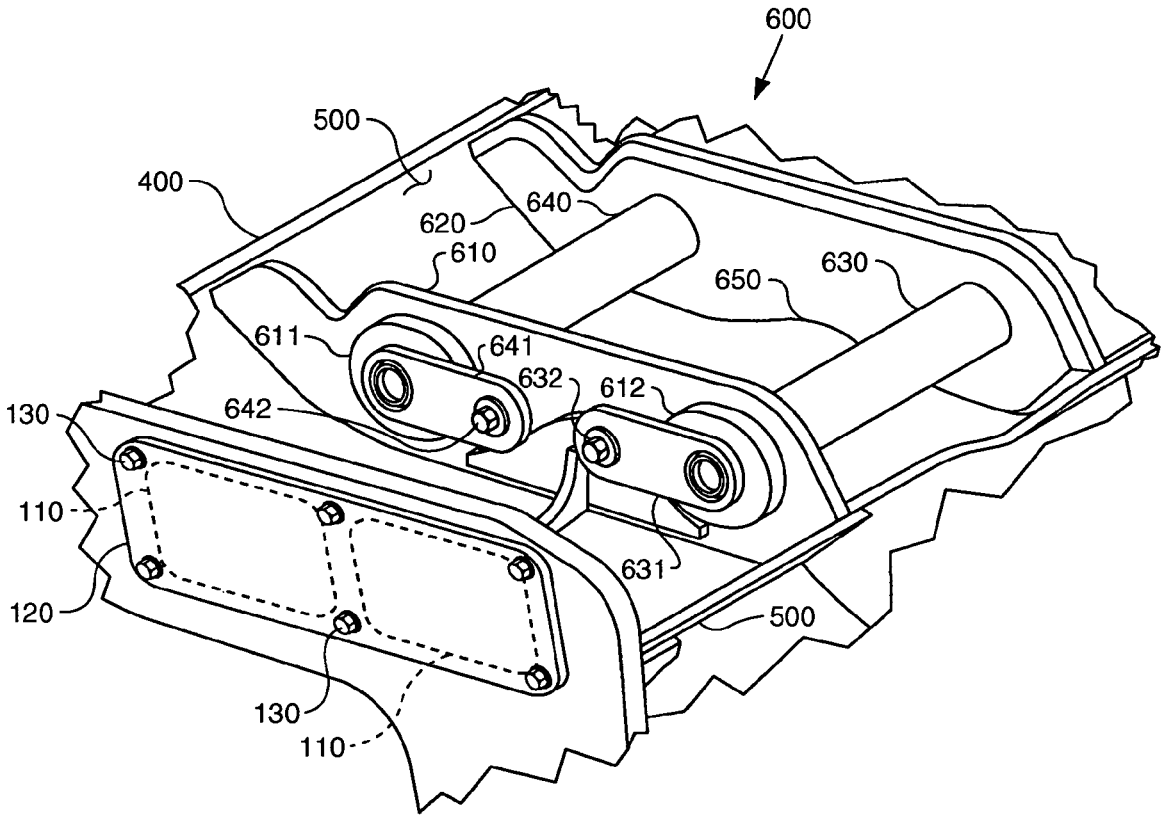
FIG. 3 is an isometric close-up view of a portion of FIG. 2.
Figure 5:
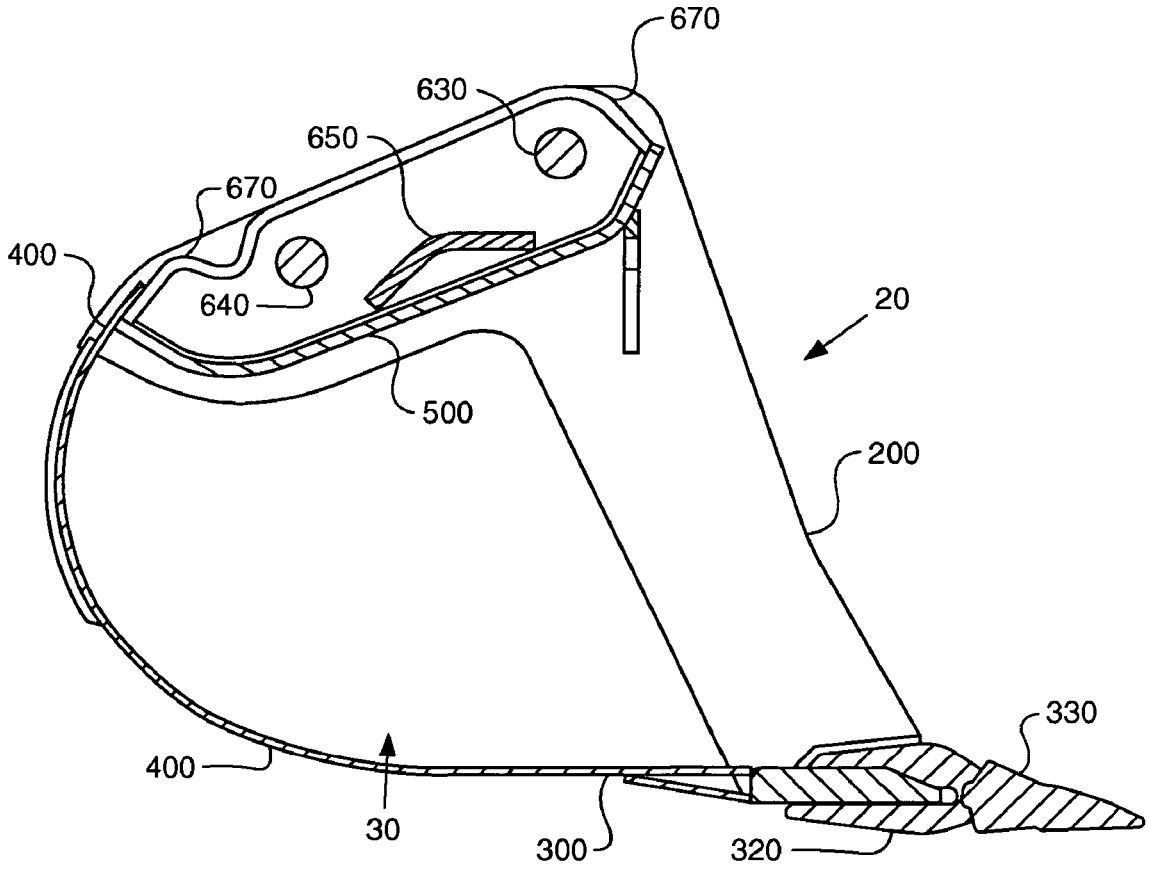
FIG. 5 is a sectional, side view of the bucket of FIG. 1 taken from cutting plane 5—5 shown in FIGS. 6 and 7.
Figure 6:
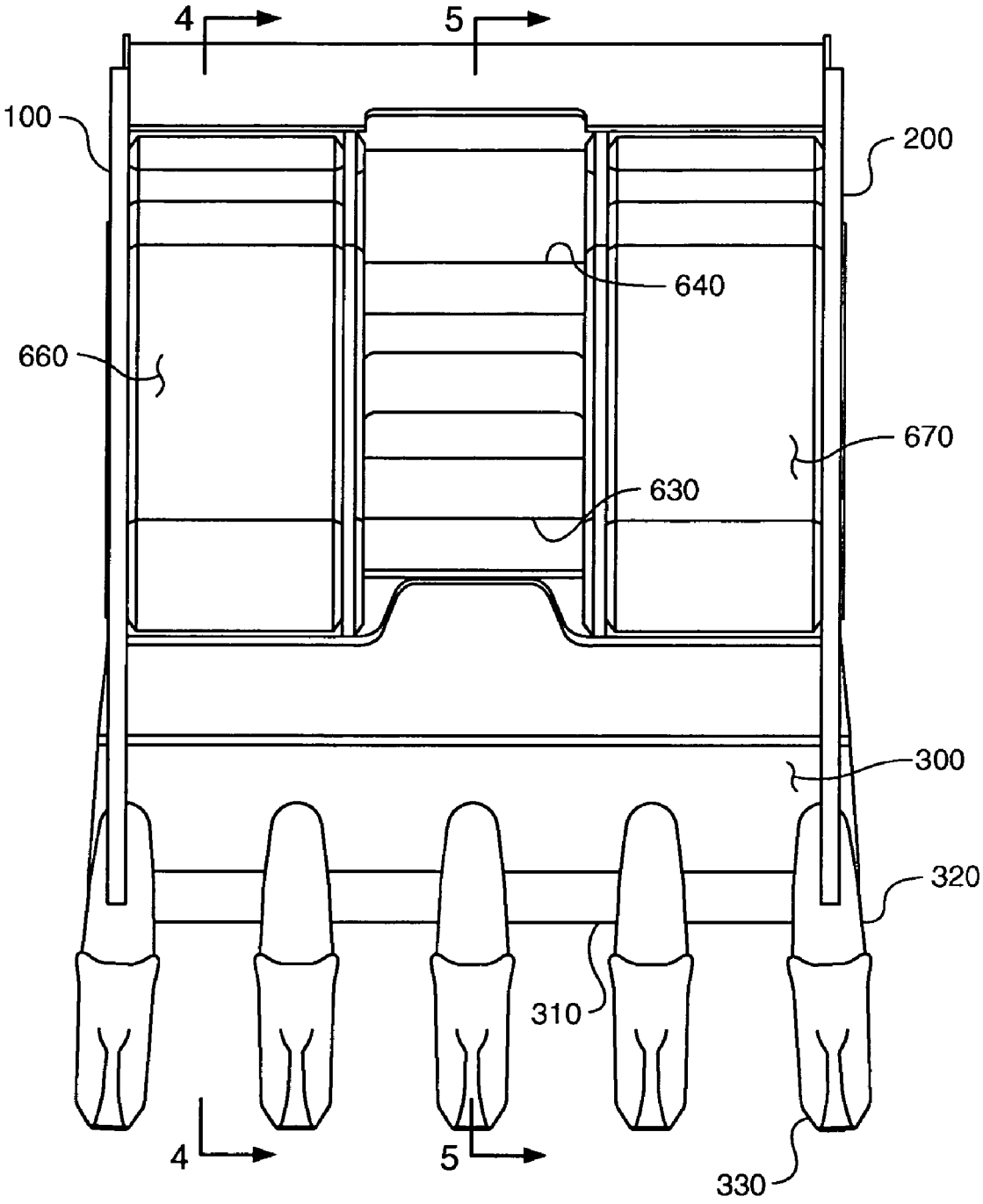
FIG. 6 is a top view of the bucket of FIG. 1.
Figure 7:
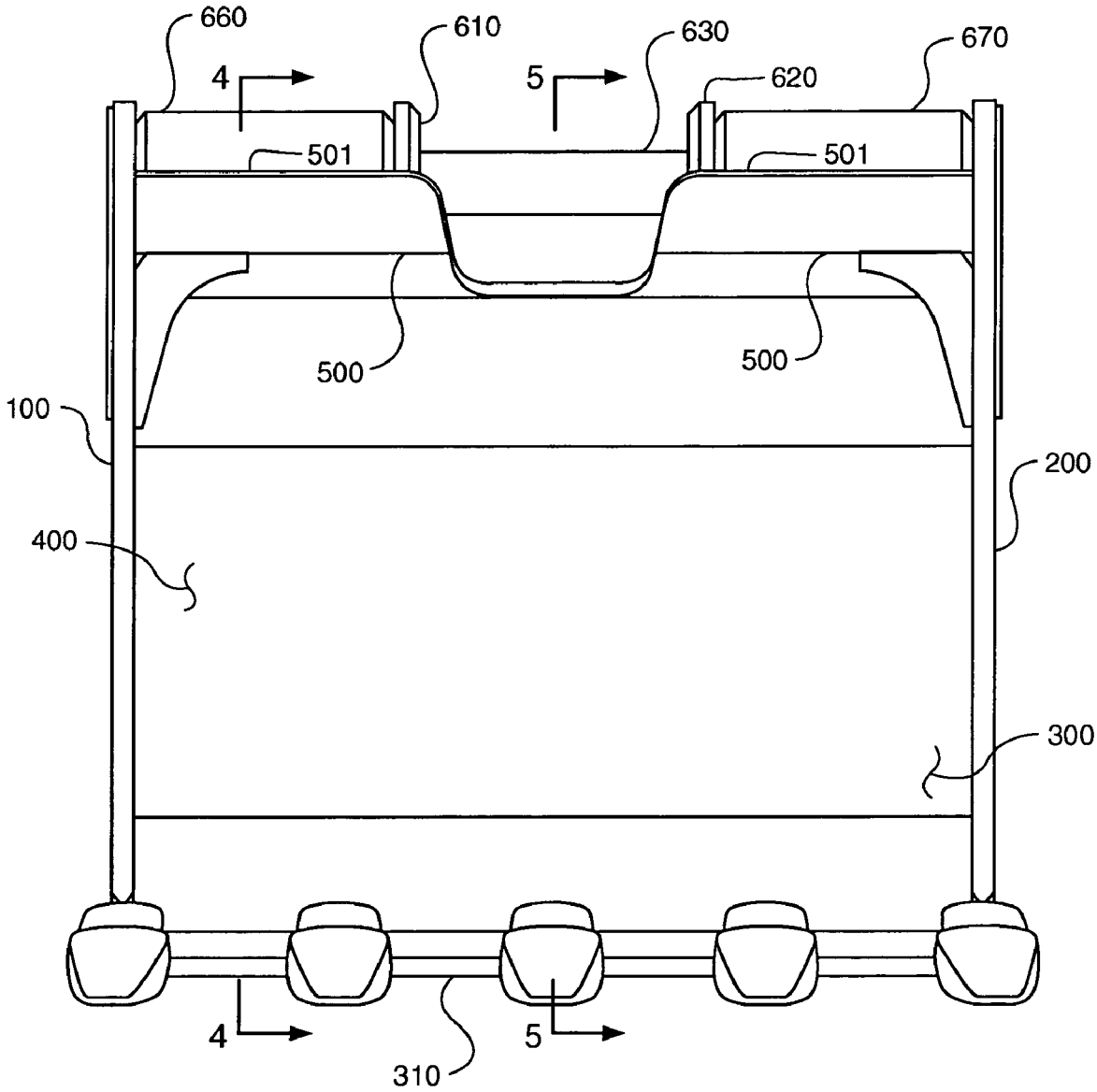
FIG. 7 is front view of the bucket of FIG. 1.

With reference to FIG. 3, pin coupling system 600 includes two longitudinally parallel and spaced apart pins 630, 640. The pins 630, 640 are sized and spaced apart according to the operative dimensions of a pin grabber quick coupler to which the bucket 10 is intended to be attached. Pins 630, 640 extend between a pair of gussets 610, 620. Gussets 610, 620 are attached to the top plate 500 and are situated between and generally parallel to side plates 100, 200. In the bucket 10 illustrated in the drawing figures, gussets 610, 620 extend along the entire top plate 500 from its front edge 501 to where it joins heel plate 400. Two bores are formed in each of the gussets 610, 620 to receive pins 630, 640. The bores are on gusset 610 are reinforced by washer-shaped reinforcement plates 611, 612. (Reinforcement plates on gusset 620 are not shown in the drawing figures, but may also be used.) As best seen in FIG. 5, a stiffener plate 650 may be placed between gussets 610, 620, and attached to the gussets and to the top plate 500.

Pins 630, 640 include flags 631, 641 attached to one end of each respective pin. The flags 631, 641 can be attached to pins 630, 640 in any suitable manner. Removable fasteners 632, 642 attach flags 631, 641 to gusset 610. Because flags 631, 641 are themselves attached to pins 630, 640, fasteners 632, 642 removably attach the pins to gusset 610 and to the bucket 10. When the pins 630, 640 require service or replacement, the fasteners 632, 642 can be removed to permit the pins to be detached from bucket 10.

If desired, cover plates 660, 670 may be attached between gussets 610, 620 and side plates 100, 200. Cover plates 660, 670 may also attach to the front edge 501 of top plate 500 and to heel plate 400, forming a generally enclosed space. In FIG. 3, cover plate 660 has been removed to view the components of pin coupling system 600. Flags 631, 641 are situated in the enclosed space formed by cover plate 660. Cover plates 660, 670 may act to further stiffen the pin coupling system 600 and the bucket 10 in general. Cover plates 660, 670 may also protect flags 631, 641 from being damaged by debris.

In order to permit pins 630 and 640 to be removed, one or more windows 110 can be provided in side plate 100. FIG. 3 shows two windows 110 in phantom lines formed in side plate 100. During removal, pins 630, 640 are slid through the bores in gusset 610 in the longitudinal direction of the pins and pass through windows 110 in the side plate 100. When cover plate 660 encloses the space around flags 631, 641, the windows 110 also permit access to fasteners 632, 642. Windows 110 may be covered by window plate 120 to prevent debris from entering the enclosed space during digging. Window plate 120 may be fastened to side plate 100 by removable fasteners such as fasteners 130.

Figure 8:
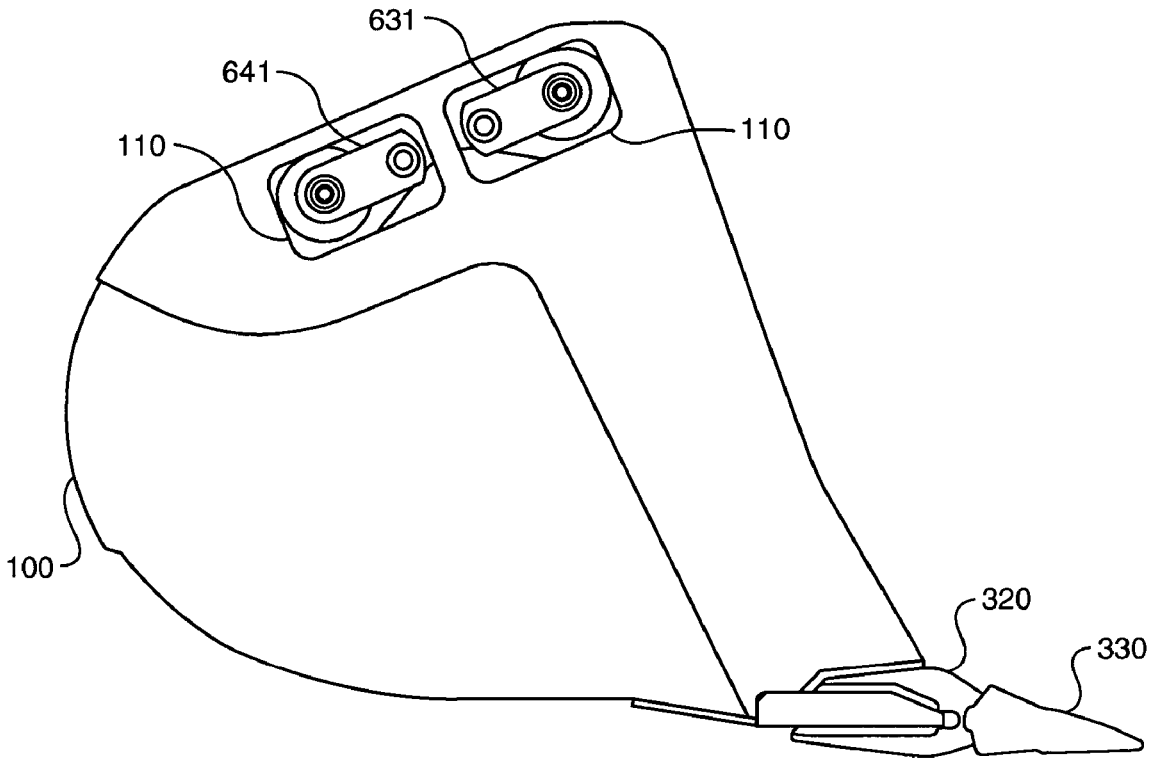
FIG. 8 is a side view of the bucket of FIG. 1.

FIG. 8 is a side view of bucket 10 with the window plate 120 removed, illustrating the access to pins 630, 640 and flags 631, 641 that is provided by the windows 110. Windows 110 are aligned with the pins 630, 640 in the pins' longitudinal direction.

FIG. 8 also illustrates that each of the pins 630, 640 is situated within the profile of the perimeter of side plates 100, 200. The longitudinal axis of each pine 630, 640 passes through each side plate 100, 200.

A window or windows similar to windows 110 may likewise be formed in side plate 200. Windows in side plate 200 could permit access to the other sides of pins 630, 640 so that a pushing force can be exerted in case the pins are jammed and difficult to extract.

Industrial Applicability

Bucket 10 can be attached to an excavator or other similar mechanical digging machine to dig soil or other material. The pair of pins 630, 640 permit the bucket to be grasped and retained by a pin grabber quick coupler, or other similar device, that is attached to the excavator. During digging, pins 630, 640 may be damaged requiring their removal for repair or replacement. Pins 630, 640 can be easily removed by detaching the fasteners which hold them to the bucket. Pins 630, 640 can then be extracted through windows 110 formed in the side plate of the bucket.

Bucket 10 is one example of a bucket constructed according to the principles of the invention. Other buckets of differing designs may also be modified according to the principles of the invention. Thus, the scope of the invention is not intended to be limited to buckets similar to bucket 10. The scope of the invention should be determined through a study of the appended claims only.

What is claimed is:

1. A bucket comprising:

a pair of spaced apart and generally parallel first and second side plates;

a base edge spanning between the first and second side plates;

a top plate spanning between the first and second side plates;

a throat defined by a front edge of the first side plate, a front edge of the second side plate, the base edge, and a front edge of the top plate;

a bucket cavity between the first and second side plates, the base edge and the top plate for holding soil or other material;

a pair of longitudinally parallel and spaced apart pins attached to the bucket; and at least one window formed in the first side plate aligned with at least one of the pair of pins in the longitudinal direction of the pin such that the longitudinal axis of the at least one of the pair of pins passes through the window.

2. A bucket according to claim 1 further comprising:

at least one window plate covering the at least one window formed in the first side plate, the at least one window plate being attached to the first side plate with a plurality of removable fasteners.

3. A bucket according to claim 1 further comprising:

a pair of spaced apart gussets attached to the top plate between the side plates, wherein each of the pins spans between the gussets.

4. A bucket according to claim 3 further comprising:

a pair of cover plates, each cover plate attached to a respective gusset and side plate and spanning therebetween to form a generally enclosed space between the top plate, a gusset, a side plate, and the cover plate.

5. A bucket according to claim 4 wherein the pins are each removably attached to one of the pair of gussets with a removable fastener.

6. A bucket according to claim 4 further comprising:

a pair of flags, each flag being attached to a respective end of one of the pair of pins; and each flag is removably attached to the gusset by a removable fastener.

7. A bucket according to claim 3 wherein the pins are each removably attached to one of the pair of gussets with a removable fastener.

8. A bucket according to claim 3 further comprising:

a pair of flags, each flag being attached to a respective end of one of the pair of pins; and each flag is removably attached to the gusset by a removable fastener.

9. A bucket comprising:

a pair of spaced apart and generally parallel first and second side plates;

a base edge spanning between the first and second side plates;

a top plate spanning between the first and second side plates;

first and second gussets attached to the top plate, the first and second gussets being generally parallel to one another and spaced apart, the first and second gussets also arranged generally parallel to and situated between the first and second side plates;

a pair of longitudinally parallel and spaced apart pins spanning between the first and second gussets, a first end of each pin being attached to the first gusset with a removable fastener; and a cover plate being attached to and spanning between the first gusset and the first side plate to generally enclose the first ends of each pin.

10. A bucket according to claim 9 wherein:

at least one window is formed in one of the pair of side plates, the window being aligned with at least one of the pair of pins such that the longitudinal axis of the at least one of the pair of pins passes through the window.

11. A bucket according to claim 10 further comprising:

at least one window plate covering the at least one window, the at least one window plate being attached to the one of a pair of side plates with a plurality of removable fasteners.

12. A bucket comprising:

a throat though which soil or other material passes when entering the bucket;

a bucket cavity for holding the soil or other material in the bucket;

a pair of spaced apart and generally parallel first and second side plates partially defining the bucket cavity;

a base edge spanning between the first and second side plates and partially defining the throat;

a pair of longitudinally parallel and spaced apart pins attached to the bucket above the bucket cavity; and at least one window formed in the first side plate aligned with at least one of the pair of pins in the longitudinal direction of the pin such that the longitudinal axis of the at least one of the pair of pins passes through the at least one window.

* * * * *

UNITED STATES PATENT AND TRADEMARK OFFICE

CERTIFICATE OF CORRECTION

PATENT NO. : 7,234,910 B2
APPLICATION NO. : 11/175946
DATED : June 26, 2007
INVENTOR(S) : Boyapally et al.

It is certified that error appears in the above-identified patent and that said Letters Patent is hereby corrected as shown below:

In the specification:

In Column 2, Line 16, delete “though” and insert --through--.

In the claims:

In Column 6, Line 24, in Claim 12, delete “though” and insert --through--.

Signed and Sealed this

Sixth Day of May, 2008

JON W. DUDAS
*Director of the United States Patent and Trademark Office*